US011464381B2

(12) United States Patent
Thorne et al.

(10) Patent No.: US 11,464,381 B2
(45) Date of Patent: Oct. 11, 2022

(54) SURFACE CLEANING APPARATUS ILLUMINATION SYSTEM

(71) Applicant: SharkNinja Operating, LLC, Needham, MA (US)

(72) Inventors: Jason B. Thorne, Dover, MA (US); Andre D. Brown, Natick, MA (US); Kai Xu, Suzhou (CN)

(73) Assignee: SharkNinja Operating LLC, Needham, MA (US)

( * ) Notice: Subject to any disclaimer, the term of this patent is extended or adjusted under 35 U.S.C. 154(b) by 0 days.

(21) Appl. No.: 17/280,007

(22) PCT Filed: Oct. 2, 2019

(86) PCT No.: PCT/US2019/054176
§ 371 (c)(1),
(2) Date: Mar. 25, 2021

(87) PCT Pub. No.: WO2020/072567
PCT Pub. Date: Apr. 9, 2020

(65) Prior Publication Data

US 2021/0307581 A1 Oct. 7, 2021

Related U.S. Application Data

(60) Provisional application No. 62/740,096, filed on Oct. 2, 2018.

(51) Int. Cl.
*A47L 9/30* (2006.01)
*A47L 5/26* (2006.01)
(Continued)

(52) U.S. Cl.
CPC *A47L 9/30* (2013.01); *A47L 5/26* (2013.01); *A47L 9/0477* (2013.01); *A47L 9/281* (2013.01)

(58) Field of Classification Search
CPC . A47L 9/30; A47L 5/26; A47L 9/0477; A47L 9/281; A47L 9/2884; A47L 9/2878; A47L 9/04; A47L 9/28
See application file for complete search history.

(56) References Cited

U.S. PATENT DOCUMENTS 5,207,498 A 5/1993 Lawrence et al.
10,272,828 B2 4/2019 White et al.
(Continued)

FOREIGN PATENT DOCUMENTS

AU 2016101847 11/2016
CN 205107556 3/2016
(Continued)

OTHER PUBLICATIONS

PCT Search Report and Written Opinion dated Dec. 30, 2019, received in PCT Application No. PCT/US19/54176, 9 pgs.
(Continued)

*Primary Examiner* — David Redding
(74) *Attorney, Agent, or Firm* — Grossman Tucker Perreault & Pfleger, PLLC

(57) ABSTRACT

A vacuum cleaner includes a vacuum body defining an agitation chamber, an agitator, and an illumination system. The agitator is rotatably disposed at least partially within the agitation chamber and includes an agitator body defining an illumination chamber. The illumination system is at least partially disposed within the illumination chamber and includes at least one light source. Alternatively, a vacuum cleaner includes a vacuum body defining an agitation chamber, an agitator rotatably disposed at least partially within the agitation chamber, an illumination coupled to the vacuum body and including at least one light source, and a light guide configured to redirect light emitted in a first direction from the at least one light source to a second direction.

18 Claims, 5 Drawing Sheets

(51) Int. Cl.
*A47L 9/04* (2006.01)
*A47L 9/28* (2006.01)

(56) References Cited

U.S. PATENT DOCUMENTS

| | | | | |
|---|---|---|---|---|
| 11,160,431 | B2 | 11/2021 | Nguyet et al. | |
| 2005/0278888 | A1 | 12/2005 | Reindle et al. | |
| 2008/0061252 | A1 | 3/2008 | Garcia et al. | |
| 2009/0126145 | A1 | 5/2009 | D'Agostino et al. | |
| 2009/0183335 | A1 | 7/2009 | Griffith et al. | |
| 2010/0263160 | A1 | 10/2010 | Oh et al. | |
| 2010/0306953 | A1 | 12/2010 | Chan | |
| 2012/0062713 | A1* | 3/2012 | Flinsenberg | A47L 9/2894 348/61 |
| 2015/0208888 | A1 | 7/2015 | Eriksson | |
| 2015/0355405 | A1* | 12/2015 | Gentile | G09F 13/02 362/611 |
| 2016/0128531 | A1 | 5/2016 | Conrad | |
| 2016/0209575 | A1 | 7/2016 | Fukui et al. | |
| 2017/0127896 | A1 | 5/2017 | Carter et al. | |

FOREIGN PATENT DOCUMENTS

| | | | |
|---|---|---|---|
| EP | 3363341 | 8/2018 | |
| EP | 3363341 A1 * | 8/2018 | A47L 9/2831 |

OTHER PUBLICATIONS

Canadian Examiner Report dated May 5, 2021, received in Canadian Patent Application No. 3,114,587, 6 pages.
Chinese Office Action with English translation dated Nov. 10, 2021, received in Chinese Patent Application No. 201980064138.9, 10 pages.
UK Office Action dated Dec. 13, 2021, received in UK Patent Application No. GB2104535.6, 4 pages.
Australian Office Action dated May 6, 2021, received in Australian Patent Application No. 2019352614, 6 pages.
Chinese Office Action dated Aug. 2, 2022, received in Chinese Patent Application No. 201980064138.9, 6 pages.

* cited by examiner

SURFACE CLEANING APPARATUS ILLUMINATION SYSTEM

CROSS REFERENCE TO RELATED APPLICATIONS

The present application claims the benefit of U.S. Provisional Application Ser. No. 62/740,096 filed on Oct. 2, 2018, which is fully incorporated herein by reference.

TECHNICAL FIELD

The present disclosure is generally directed to surface treatment apparatuses and more specifically to a surface cleaning apparatus illumination system.

BACKGROUND INFORMATION

Surface treatment apparatuses may include vacuum cleaners configured to suction debris from a surface (e.g., a floor). The vacuum cleaner may include a surface cleaning head having one or more brush rolls configured to agitate a surface (e.g., a carpet) to urge debris into an airflow stream generated by a suction motor of the vacuum cleaner. The debris within the airflow stream may then be deposited in a debris collector (e.g., a bag) for later disposal. In some applications, the suction motor and/or agitator is powered by one or more batteries (e.g., rechargeable batteries).

BRIEF DESCRIPTION OF THE DRAWINGS

These and other features and advantages will be better understood by reading the following detailed description, taken together with the drawings, wherein.

DETAILED DESCRIPTION

By way of a brief overview, the present disclosure may feature a vacuum cleaner including a vacuum body defining an agitation chamber, an agitator, and an illumination system. The agitator is rotatably disposed at least partially within the agitation chamber and includes an agitator body defining an illumination chamber. The illumination system is at least partially disposed within the illumination chamber and includes at least one light source. The illumination system may be stationary with respect to the vacuum body and/or may rotate with the agitator. The light emitted by the illumination system may pass through the agitator body, and optionally may be emitted through a portion of the vacuum body. Alternatively, a vacuum cleaner includes a vacuum body defining an agitation chamber, an agitator rotatably disposed at least partially within the agitation chamber, an illumination coupled to the vacuum body and including at least one light source, and a light guide configured to redirect light emitted in a first direction from the at least one light source to a second direction.

Figure 1:
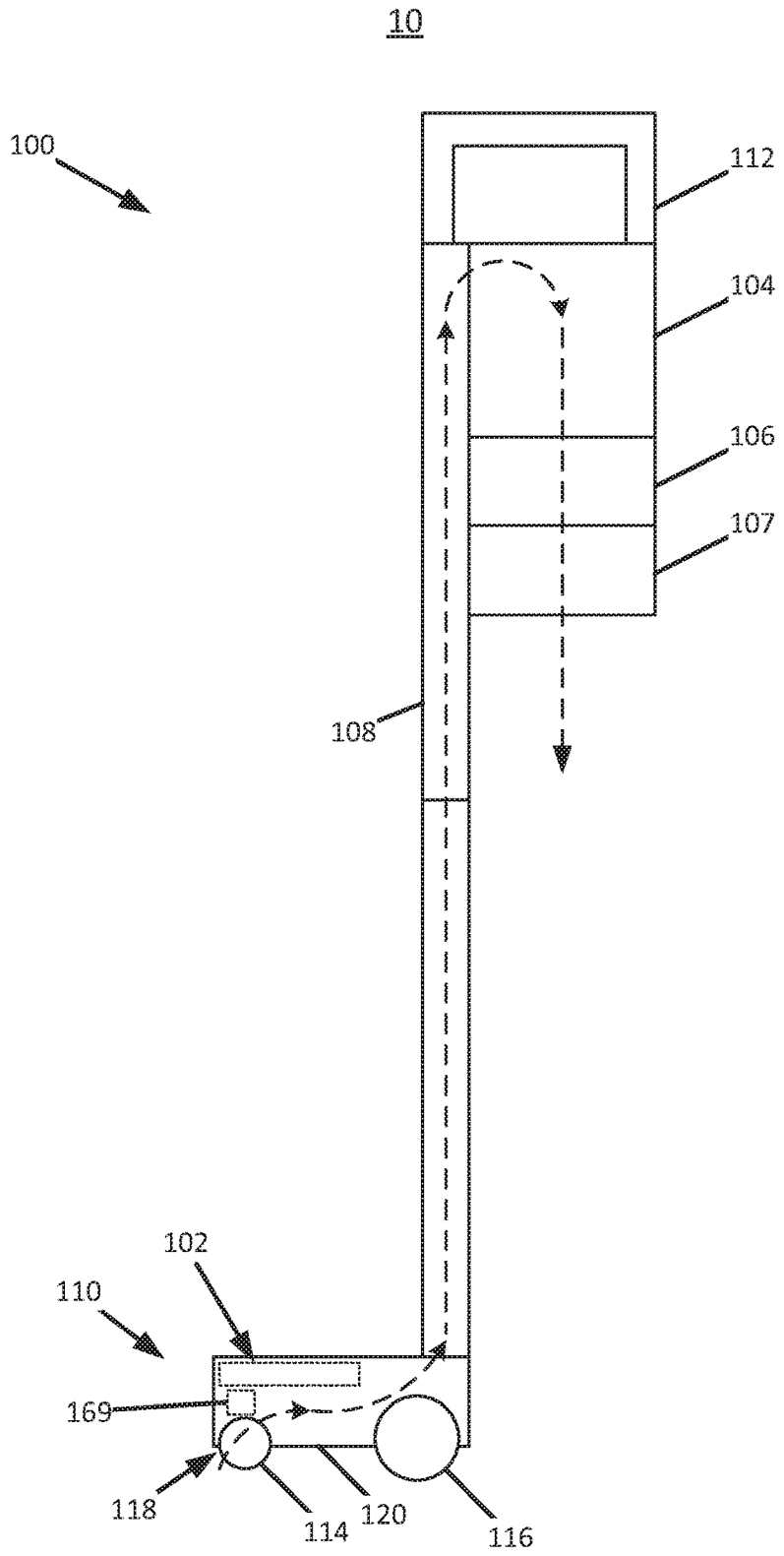
FIG. 1 shows a schematic view of vacuum cleaner including an illumination system, consistent with embodiments of the present disclosure.
Figure 2:
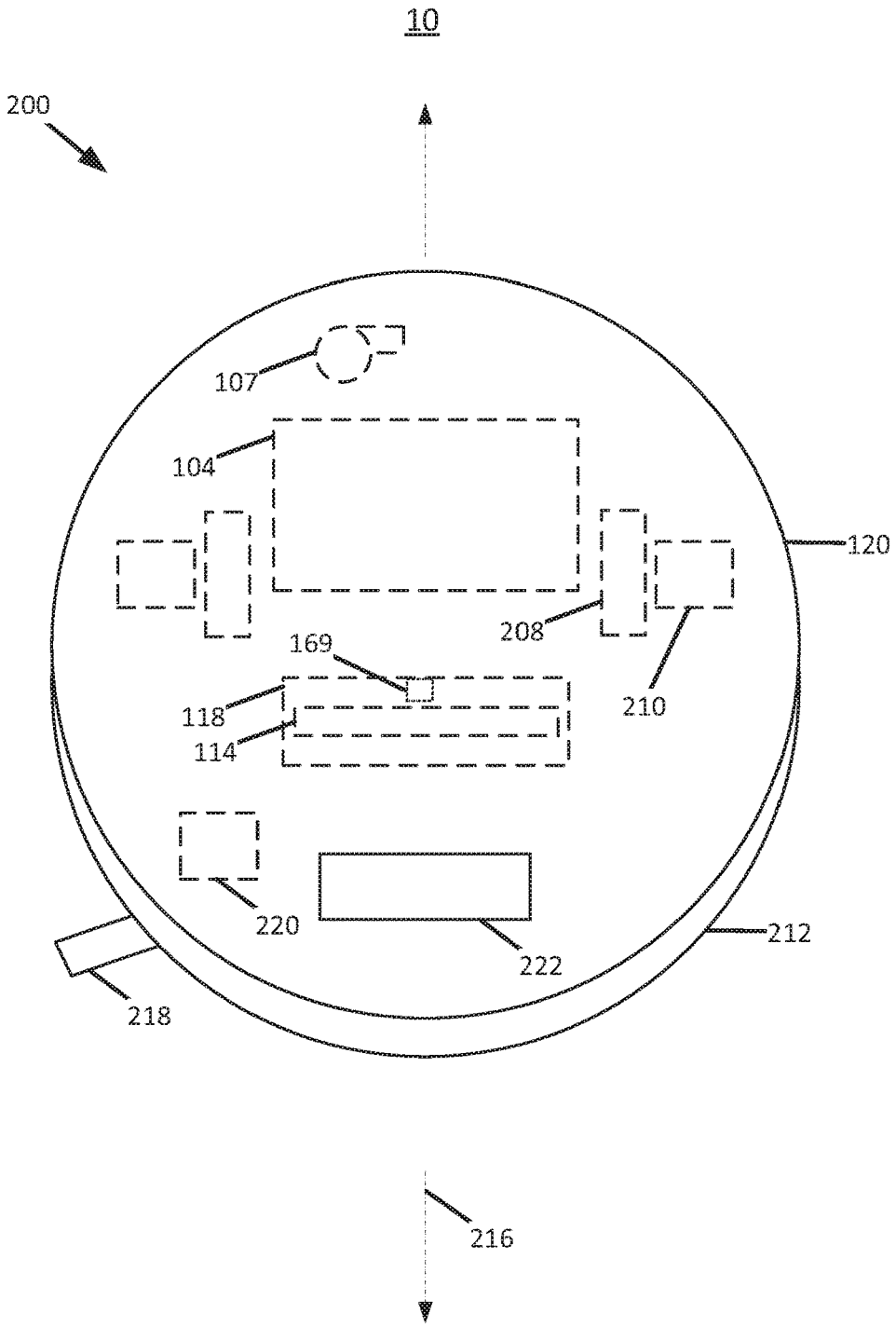
FIG. 2 shows a schematic view of another embodiment of a vacuum cleaner including an illumination system, consistent with embodiments of the present disclosure.

FIGS. 1 and 2 show exemplary embodiments of a vacuum cleaner 10, each including an illumination system 102 consistent with one or more embodiments of the present disclosure. As explained herein, the illumination system 102 may be configured to illuminate an area being cleaned, provide an aesthetically pleasing appearance, and/or function as an input and/or output device (e.g., but not limited to, provide information regarding the status of one or more parameters of the vacuum cleaner). The term vacuum cleaner 10 is intended to refer to any type of vacuum cleaner including, but not limited to, hand-operated vacuum cleaners 100 and robot vacuum cleaners 200.

Turning now to FIG. 1, an exemplary embodiment of a hand-operated vacuum cleaner 100 is generally illustrated. The hand-operated vacuum cleaner 100 may include any vacuum cleaner known to those skilled in the art including, but not limited to, an "all in the head" type vacuum, upright vacuum cleaners, canister vacuum cleaners, stick vacuum cleaners, and central vacuum cleaners. It should be understood that the hand-operated vacuum cleaner 100 shown is for exemplary purposes only and that a hand-operated vacuum cleaner 100 may not include all of the features shown in FIG. 1 and/or may include additional features not shown in FIG. 1. For exemplary purposes only, a hand-operated vacuum cleaner 100, FIG. 1, may include a debris compartment 104, one or more filters 106, one or more suction motors 107, a fluid conduit 108, a handle 110, and a nozzle or surface treatment head 112. The surface treatment head 112 may include one or more rotatable agitators 114 and/or one or more wheels 116. The rotatable agitators 114 may be driven by one or more motors disposed within the hand-operated vacuum cleaner 100 and may be at least partially disposed in an air inlet 118, for example, formed in the body 120 of surface treatment head 112. By way of a non-limiting example, the agitator 114 may include a rotatable bush bar having a plurality of bristles. The surface treatment head 112 may optionally include a power source (such as one or more batteries) and/or a power cord. As explained herein, the hand-held vacuum cleaner 100 (e.g., but not limited to, the surface treatment head 112) may include one or more illumination systems 102.

FIG. 2 shows a schematic view of an example of a robotic vacuum cleaner 200. It should be understood that the robotic vacuum cleaner 200 shown is for exemplary purposes only and that a robotic vacuum cleaner 200 may not include all of the features shown in FIG. 2 and/or may include additional features not shown in FIG. 2. The robotic vacuum cleaner 200 may include an air inlet 118 fluidly coupled to a debris compartment 104 and a suction motor 107. The suction motor 107 causes debris to be suctioned into the air inlet 118 and deposited into the debris compartment 104 for later disposal. The robotic vacuum cleaner 200 may optionally include one or more agitators 114 at least partially disposed within the air inlet 118. The agitator 114 may be driven by one or more motors disposed within the robotic vacuum cleaner 200. By way of a non-limiting example, the agitator 114 may include a rotatable bush bar having a plurality of bristles. The robotic vacuum cleaner 200 includes a plurality of wheels 208 coupled to a respective drive motor 210. As such, each wheel 208 may generally be described as being independently driven. The robotic vacuum cleaner 200 can be steered by adjusting the rotational speed of one of the plurality of wheels 208 relative to the other of the plurality of wheels 208. One or more side brushes 218 can be positioned such that a portion of the side brush 218 extends at least to (e.g., beyond) the perimeter defined by a vacuum housing 120 of the robotic vacuum cleaner 200. The side brush 218 can be configured to urge debris in a direction of the air inlet 118 such that debris located beyond the perimeter of the vacuum housing 120 can be collected. For example, the side brush 218 can be configured to rotate in response to activation of a side brush motor 220.

A user interface 222 can be provided to allow a user to control the robotic vacuum cleaner 200. For example, the user interface 222 may include one or more push buttons that correspond to one or more features of the robotic vacuum cleaner 200. The robotic vacuum cleaner 200 may optionally include a power source (such as one or more batteries) and/or one or more displaceable bumpers 212 disposed along a portion of the perimeter defined by a vacuum housing 120 of the robotic vacuum cleaner 200. The displaceable bumper 212 may displaced in response to engaging (e.g., contacting) at least a portion of an obstacle that is spaced apart from the surface to be cleaned. Therefore, the robotic vacuum cleaner 200 may avoid becoming trapped between the obstacle and the surface to be cleaned. As explained herein, the robotic vacuum cleaner 200 may include one or more illumination systems 102.

Figure 3:
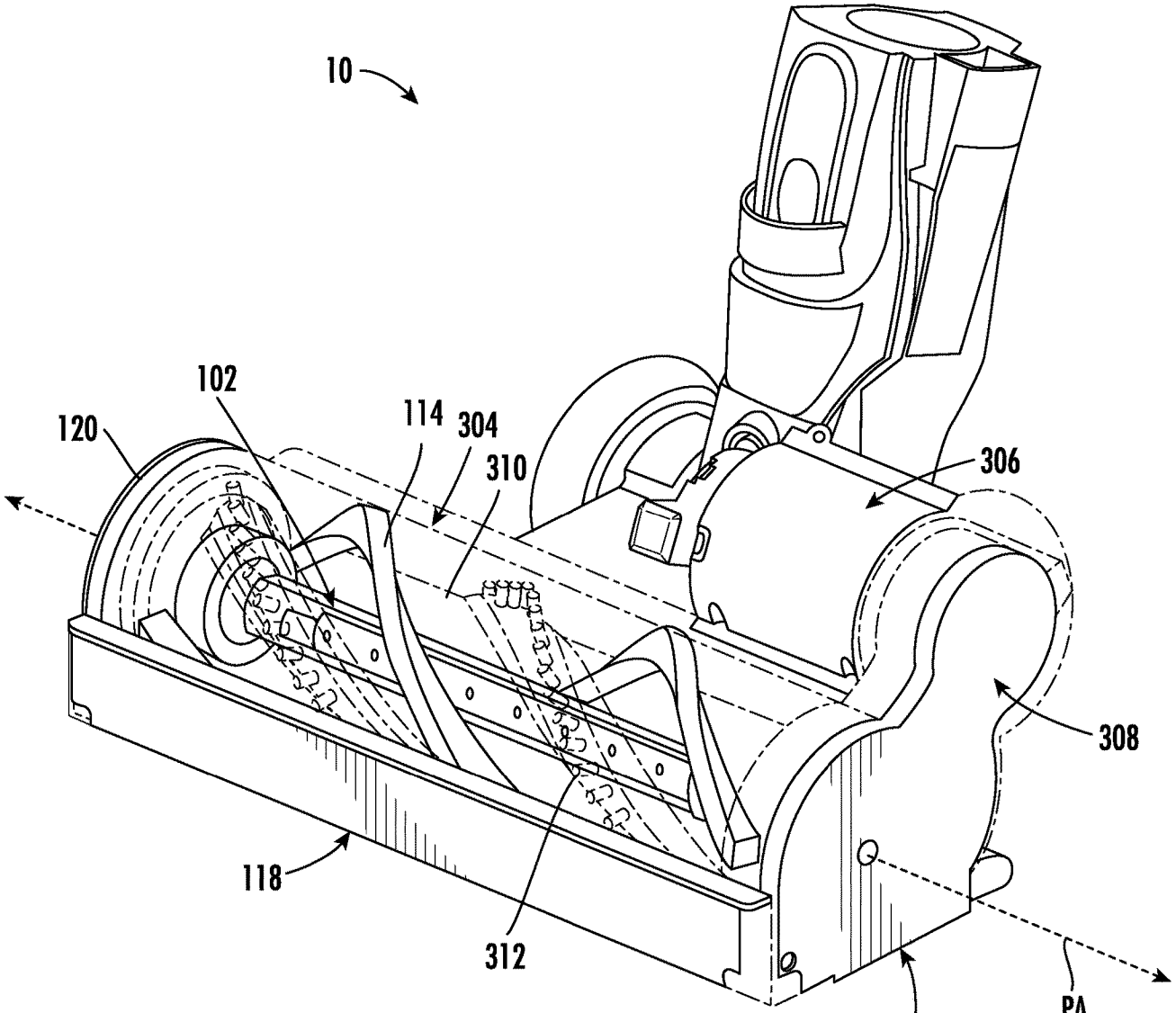
FIG. 3 shows a schematic view of one embodiment the illumination system of FIGS. 1 and 2 consistent with one embodiment of the present disclosure.

Turning now to FIG. 3, a close-up perspective view of a vacuum cleaner 10 having one embodiment of an illumination system 102 consistent with the present disclosure is generally illustrated. As used herein, the term vacuum cleaner 10 is intended to refer to any type of vacuum cleaner including, but not limited to, hand-held vacuum cleaners 100 and robot vacuum cleaners 200. As such, while the illumination system 102 is shown in combination with a surface treatment head 112 of a hand-held vacuum cleaner 100, it should be appreciated that the illumination system 102 may also be included in any vacuum cleaner including, but not limited to, a robot vacuum cleaner 200.

The vacuum cleaner 10 includes a vacuum body or housing 120 defining at least one air inlet 118. In the illustrated embodiment, the air inlet 118 is formed on a bottom surface 302 of the vacuum housing 120. One or more agitators 114 are at least partially disposed within the vacuum housing 120, for example, within an agitator chamber 304 at least partially formed by the vacuum housing 120. A portion of the agitator 114 may extend beyond the air inlet 118 and may be configured to contact a surface to be cleaned (e.g. a floor and/or carpet). One or more motors 306 may be directly or indirectly coupled (e.g., using a drivetrain 308 such as gears, belts, or the like) to the agitator 114 to rotate the agitator 114 within the air inlet 118 about a pivot axis PA in any manner known to those skilled in the art. The agitator 114 may include an agitator body 310 and one or more agitating features 312 such as, but not limited to, bristles (e.g., continuous and/or discontinuous rows of bristles and/or tufts of bristles), felt, flexible strips (e.g., rubber strips or the like), flexible and/or rigid sidewalls, and/or the like). The agitator body 310 may be referred to as an elongated agitator body 310 because the length of the agitator body 310 along the pivot axis PA may be greater than the width or height (e.g., the diameter) of the agitator body 310. For example, the length of the agitator body 310 along the pivot axis PA may be at least twice the width or height (e.g., the diameter) of the agitator body 310, or for example, at least four times the width or height (e.g., the diameter) of the agitator body 310.

Figure 4:
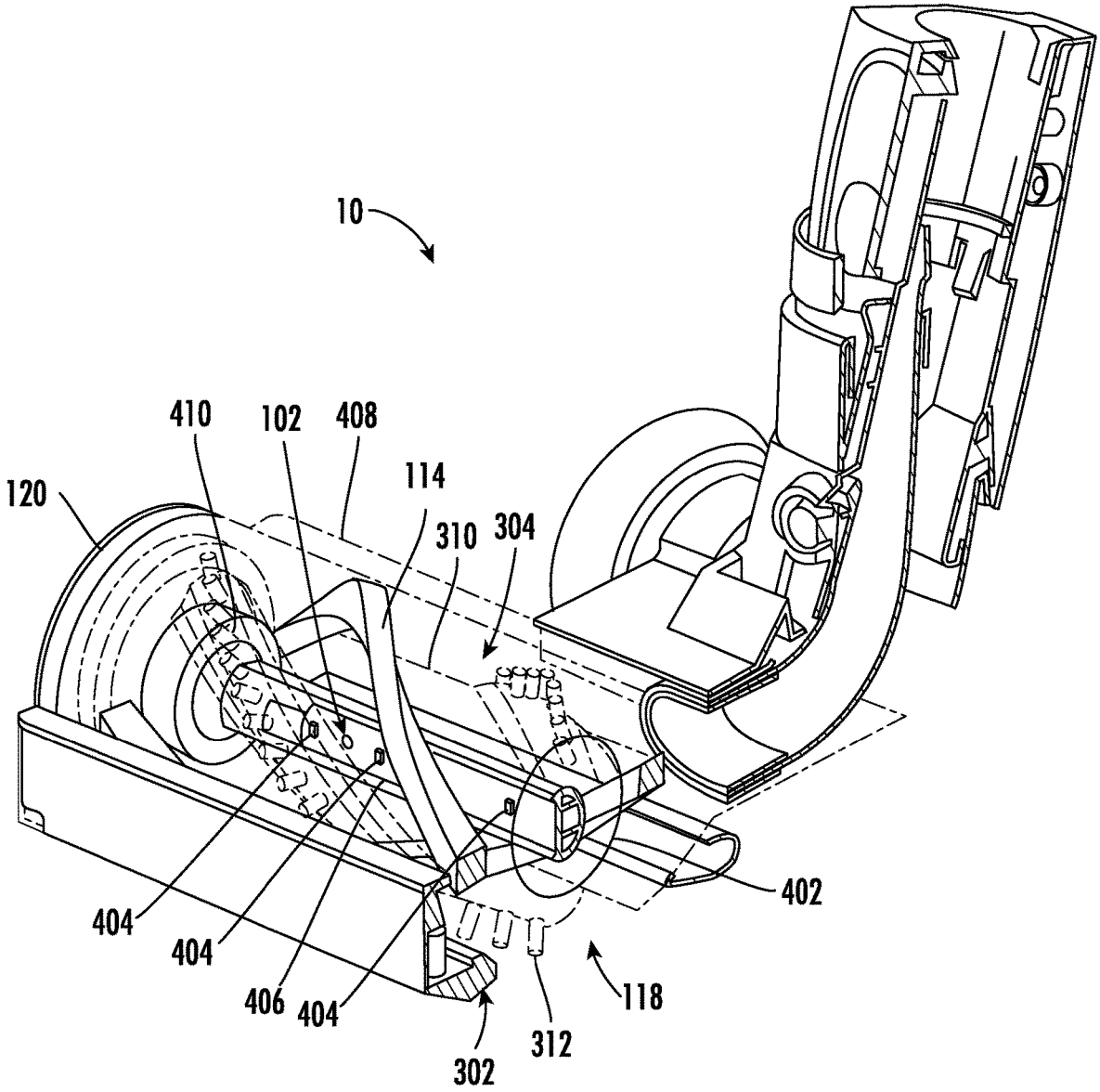
FIG. 4 shows a cross-sectional view of the illumination system of FIG. 3.

With reference to FIG. 4, a cross-sectional view of the agitator body 310 of FIG. 3 is generally illustrated. The agitator body 310 may include one or more illumination chambers 402 configured to receive at least a portion of one or more illumination systems 102. The illumination chambers 402 may extend along all or a portion of the elongated agitator body 310. For example, one or more of the illumination chambers 402 extend from a first opening disposed proximate a first end of the elongated agitator body 310 to a second, oppositely disposed opening disposed proximate a second, opposite end of the elongated agitator body 310. Alternatively (or in addition), one or more of the illumination chambers 402 may be disposed within a central region of the elongated agitator body 310 (i.e., which is not open to the first and second ends) and/or may extend from one of the ends partially towards the other end of the elongated agitator body 310.

The illumination chambers 402 may be configured to receive at least a portion of the illumination system 102. For example, the illumination system 102 may include one or more light sources 404 coupled to a support surface 406. According to one embodiment, the light sources 404 may include one or more light emitting diodes (LEDs); however, it should be appreciated that the light sources 404 may include any light source known to those skilled in the art. According to one embodiment, one or more of the light sources 404 may be configure to emit light in the visible light spectrum. For example, one or more of the light sources 404 may be configured to emit white light (i.e., containing a combination of light in having wavelengths from about 400 nm to about 700 nm). The white light may be used to illuminate an area proximate to the vacuum cleaner 10. Alternatively (or in addition), one or more of the light sources 404 may be configured to emit light having another color such as, but not limited to, red, yellow, blue, green, orange, and the like. The light sources 404 may be configured to emit light in specific wavelength ranges and/or patterns to convey information to a user. For example, the light sources 404 may emit light within one or more specific wavelength ranges and/or patterns to convey information about one or more parameters of the vacuum cleaner 10 including, but not limited to, battery life, suction power, status of the filters 106, remaining capacity of the debris compartment 104, amount of debris being picked up (i.e., how dirty the surface is being vacuumed), remaining runtime, operating time (i.e., how long the vacuum cleaner has been operating), error and mode communication, or the like. Alternatively (or in addition), the light sources 404 may be adjustable by the user to emit light in different wavelength ranges.

According to one embodiment, one or more of the light sources 404 may be configure to emit light in the infrared (IR) light spectrum (i.e., light with a wavelength from about 700 nm to 1 mm) For example, the IR light emitted by the light sources 404 may be used for navigational purposes, for example, to detect obstacles in a room.

According to another embodiment, one or more of the light sources 404 may be configured to emit light in the ultraviolet (UV) light spectrum (i.e., light with a wavelength from 10 nm to 400 nm). For example, the UV light emitted by the light sources 404 may be used to disinfectant for the vacuum cleaner 10. The UV light may therefore reduce bacteria and/or mold growth on vacuum cleaner 10, for example, on the agitator 114 and/or within the agitator chamber 118. Alternatively (or in addition), the UV light emitted by the light sources 40 may be configured to be absorbed by debris on the agitator 114 (e.g., debris such as hair and/or fur wrapped around the agitator 114). The UV light may break-down the hair and/or fur. For example, the UV light may disrupt protein bonds within the hair and/or fur, thereby causing the hair/fur to more easily break into smaller pieces/segments that can be removed from the agitator 114 and collected in the debris compartment 104. The agitator 114 and/or the vacuum housing 120 may optionally be formed from a UV resistant material. For example, the agitator 114 and/or the vacuum housing 120 may be formed from a UV resistant plastic and/or from a material having one or more UV resistant coatings/layers and/or UV stabilizers. Non-limiting examples of UV resistant plastic materials include acrylic, polyetherimide (PEI), polyvinylidene fluoride (PVDF), and polytetrafluoroethylenez (PTFE).

One or more of the light sources 404 may be energized when the vacuum cleaner 10 is powered (i.e., when the vacuum cleaner 10 is operating to remove debris from a surface). For example, one or more of the light sources 404 may be energized whenever the vacuum cleaner 10 is powered and/or one or more of the light sources 404 may be selectively energized. Alternatively (or in addition), one or more of the light sources 404 may be energized when the vacuum cleaner 10 is off (i.e., when the vacuum cleaner 10 is not operating to remove debris from a surface).

According to one embodiment, the light sources 404 may be energized when the vacuum cleaner 10 is placed on and/or in (e.g., coupled to) a storage dock. Some or all of the light sources 404 may be configured to emit light (e.g., but not limited to, UV light) which is contained substantially entirely within the vacuum cleaner 10 (e.g., the UV light emitted by the light sources 404 is generally not visible to a user). Such an embodiment may allow the light sources 404 to emit light over a longer period of time (thus enhancing the ability of the light source 404 to break-down debris wrapped around the agitator 114). As noted above, the light sources 404 may be coupled to one or more support surfaces 406. According to one embodiment, the support surface 406 may include a printed circuit board (PCB). The PCB may include any necessary circuitry such as, but not limited to, power conditioners, voltage regulators, sensors, or the like. Alternatively, the support surface 406 may include any mounting surface to which the light sources 404 may be secured.

According to one embodiment, the illumination system 102 is stationarily disposed within the illumination chamber 402 (i.e., the illumination system 102 does not move relative to the vacuum housing 120 and the agitator 114 rotates around the illumination system 102) about pivot axis PA. The agitator body 310 may be formed from a transparent and/or semi-transparent material that allows at least some of the light emitted by the light sources 404 (such as, but not limited to, visible light, UV light, and/or IR light) disposed within the illumination chamber 402 to pass through the agitator body 310. Optionally, one or more of the agitating features 312 may be formed from a transparent and/or semi-transparent material that allows at least some of the light emitted by the light sources 404 disposed within the illumination chamber 402 to pass through the agitating features 312. According to one embodiment, a least a portion of the body 120 may be formed from a transparent and/or semi-transparent material that allows at least some of the light emitted by the light sources 404 disposed within the illumination chamber 402 to pass through the body 120. For example, the body 120 may include a transparent and/or semi-transparent cover or lid 408 that extends over (and optionally partially defines) the agitator chamber 118. The cover/lid 408 may function as a window that allows a user to see at least partially into the agitator chamber 118 and through which at least a portion of the agitator 114 and the illumination system 102 may be visible from the exterior while the vacuum cleaner 10 is in normal use (i.e., while cleaning a floor). As used herein, a material is considered transparent if at least 90% of the light which intersects with the material passes through the material, and a material is considered semi-transparent if at least 30% of the light which intersects with the material passes through the material.

Optionally, one or more seals 410 (e.g., but not limited to, O-rings or the like) may be provided to seal at least a portion of the illumination chamber 402 (e.g., the portion which includes the light sources 404) from debris in the agitation chamber 118. For example, one or more seals 410 may be disposed proximate each end of the illumination chamber 402.

According to another embodiment, the illumination system 102 may be configured to rotate with the agitator 114. The light sources 404 may be coupled directly to the agitator body 310 and/or may be secured within one or more illumination chambers 402 formed within the agitator body 310. The light sources 402 may include a power source that is separate from the rest of the vacuum cleaner 10. For example, the light sources 404 may include separate batteries and/or may be powered by a magnetic induction system in which rotation of the agitator 114 may induce a current used to power the light sources 404. Alternatively, one or more rotatable electrical connections may be provided between the agitator 114 and the vacuum housing 120 to provide electricity to the light sources 404.

Figure 5:
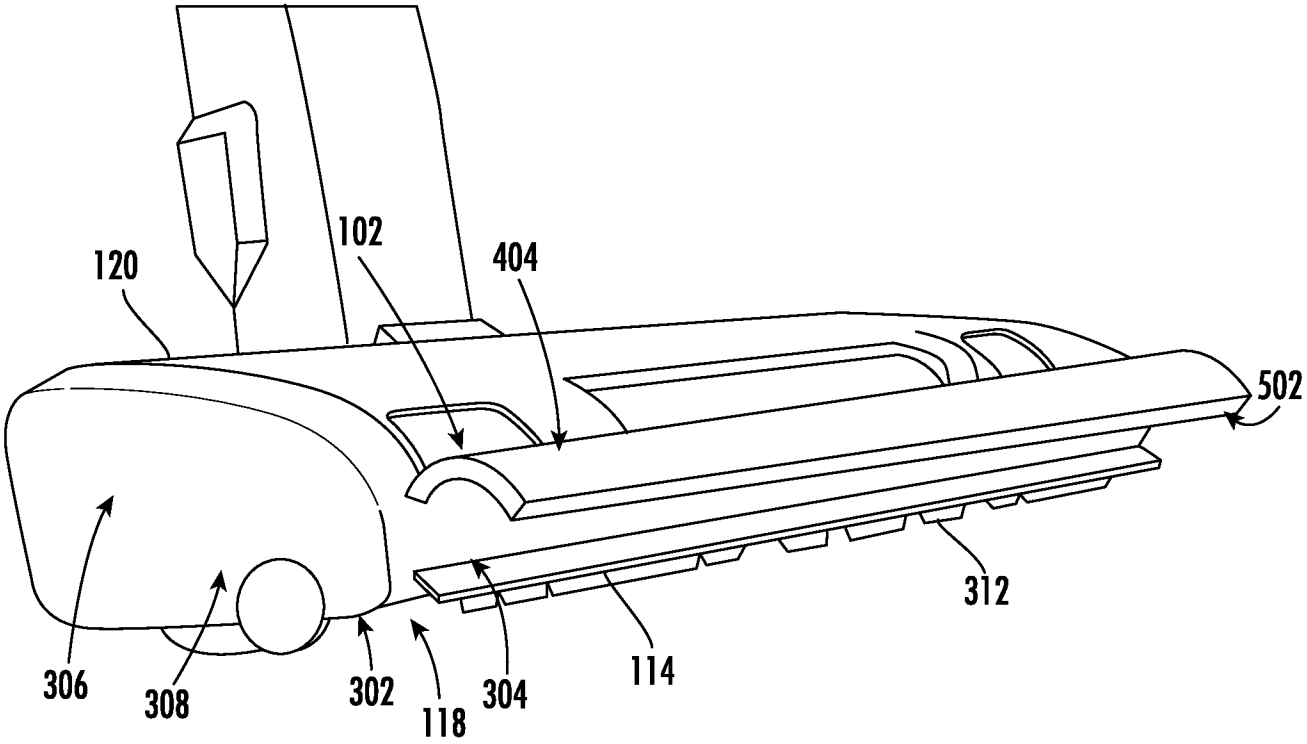
FIG. 5 shows a schematic view of another embodiment the illumination system of FIGS. 1 and 2 consistent with one embodiment of the present disclosure.

Turning now to FIG. 5, one example of vacuum cleaner 10 including another embodiment of an illumination system 102 consistent with the present disclosure is generally illustrated. As noted previously, while the illumination system 102 is shown in combination with a surface treatment head 112 of a hand-held vacuum cleaner 100, it should be appreciated that the illumination system 102 may also be included in any vacuum cleaner including, but not limited to, a robot vacuum cleaner 200.

The illumination system 102 includes one or more light sources 404 and one or more waveguides, light guides, and/or light tubes 502. The light sources 404 may include any light source known to those skilled in the art including, but not limited to, one or more LEDs. The light sources 404 may be configured to emit light generally in the direction of the waveguide, light guide, and/or light tubes 502. The waveguides, light guides, and/or light tubes 502 may include one or more light receiving surfaces and one or more light emitting surfaces. Optionally, the waveguide, light guide, and/or light tube 502 may include one or more lenses, diffusers, or the like to configured to emit light in a desired illumination pattern. One such illumination pattern includes illuminating an area in proximate to and in front of the vacuum cleaner 10 (e.g., in front of and proximate to the surface treatment head 112 and/or the body 120).

The waveguide, light guide and/or light tube 502 may configured to guide the light passing therethrough from a first direction (i.e., the direction emitted from the light source 404) to a second, different direction (e.g., the desired illumination pattern). One example of a waveguide, light guide and/or light tube 502 may include a structure which utilizes total internal refraction. Some of the light emitted from the light sources 404 may be used to illuminate areas to the left and/or right of the vacuum cleaner 10 and/or in front of (and/or behind) the vacuum cleaner 10). According to one embodiment, the waveguide, light guide and/or light tube 502 may include at least an upper surface through which substantially no light passes through (i.e., less than 10% of light passes through). Preventing light from being emitted through this upper surface may generally prevent the light being emitted directly towards the user which could cause undesired glare.

The light guide 502 may be configured to receive at least a portion of the light emitted by one or more light sources 404. The light sources 404 may be mounted anywhere on the vacuum cleaner 10. For example, the light sources 404 may be disposed within the agitation chamber 304, within the illumination chamber 402, and/or external to the agitation chamber 304 and the illumination chamber 402 (e.g., mounted on/in the vacuum housing 120). According to one embodiment, the light guide 502 is formed by the transparent agitator window in the vacuum body 120. Alternatively (or in addition), the light guide 502 is configured to receive formed by the transparent agitator window in the vacuum body 120.

Turning back to FIGS. 1 and 2, the vacuum cleaner 10 may include one or more debris sensors 169. The debris sensor 169 may be configured to generate a signal based on the amount of debris within and/or proximate to the agitator chamber agitator chamber 304. The light sources 404 of the illumination system 102 may be configured to change colors based on the amount of debris detected by the debris sensor 169.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A vacuum cleaner comprising:

a vacuum body defining an agitation chamber;

an agitator rotatably disposed at least partially within said agitation chamber;

an illumination system coupled to said vacuum body, said illumination system comprising at least one light source; and a light guide configured to redirect light emitted in a first direction from said at least one light source to a second direction, wherein said light guide utilizes total internal refraction to redirect light emitted by said at least one light source;

wherein said light guide comprises a transparent or semi-transparent window to said agitation chamber and is formed from a portion of said vacuum body.

2. The vacuum cleaner of claim 1, wherein said agitator rotates around said illumination system.

3. A vacuum cleaner comprising:

a vacuum body defining an agitation chamber;

an agitator rotatably disposed at least partially within said agitation chamber;

at least one light source; and a light guide comprising a transparent or semi-transparent window partially defining said agitation chamber, said light guide configured to redirect light emitted in a first direction from said at least one light source to a second direction, wherein said light guide utilizes total internal refraction to redirect light emitted by said at least one light source.

4. The vacuum cleaner of claim 3, wherein said at least one light source includes one or more light emitting diodes.

5. The vacuum cleaner of claim 3, wherein said light guide is formed from a portion of said vacuum body.

6. The vacuum cleaner of claim 3, wherein said at least one light source is configured to emit light in the ultraviolet light spectrum.

7. The vacuum cleaner of claim 3, wherein said light source changes color based on one or more parameters of said vacuum cleaner.

8. The vacuum cleaner of claim 7, wherein said one or more parameters of the vacuum cleaner include battery life.

9. The vacuum cleaner of claim 7, wherein said one or more parameters of the vacuum cleaner include suction power.

10. The vacuum cleaner of claim 7, wherein said one or more parameters of the vacuum cleaner include a status of a filter.

11. The vacuum cleaner of claim 7, wherein said one or more parameters of the vacuum cleaner include remaining capacity of a debris compartment.

12. The vacuum cleaner of claim 7, wherein said one or more parameters of the vacuum cleaner include an amount of debris being picked up.

13. The vacuum cleaner of claim 7, wherein said one or more parameters of the vacuum cleaner include a remaining runtime.

14. The vacuum cleaner of claim 3, wherein said light source changes color and/or pattern based on one or more parameters of said vacuum cleaner.

15. The vacuum cleaner of claim 3, wherein said vacuum cleaner is a robotic vacuum cleaner.

16. The vacuum cleaner of claim 7, wherein said light source changes color based on a debris sensor.

17. The vacuum cleaner of claim 3, wherein said vacuum cleaner is a hand-held vacuum cleaner.

18. A vacuum cleaner comprising:

a vacuum body defining an agitation chamber;

a suction motor fluidly coupled to said agitation chamber and at least one filter;

an agitator rotatably disposed at least partially within said agitation chamber;

at least one light source; and a cover that extends over and partially defines said agitation chamber, said cover including a window configured to allow a user to see at least partially into said agitator chamber, said window including a light guide configured to receive light emitted by said at least one light source and redirect said light using total internal refraction to illuminate an area proximate to said vacuum cleaner.

* * * * *